US007780128B2

(12) United States Patent
Walsberg

(10) Patent No.: US 7,780,128 B2
(45) Date of Patent: Aug. 24, 2010

(54) LEVELING SYSTEM AND METHOD

(76) Inventor: Martin C. Walsberg, 328 E. Herbert St., Pontiac, IL (US) 61764

( * ) Notice: Subject to any disclaimer, the term of this patent is extended or adjusted under 35 U.S.C. 154(b) by 285 days.

(21) Appl. No.: 12/017,198

(22) Filed: Jan. 21, 2008

(65) Prior Publication Data

US 2009/0184614 A1 Jul. 23, 2009

(51) Int. Cl.
*F16M 11/24* (2006.01)

(52) U.S. Cl. ..... 248/188.4; 248/188.2; 248/354.3; 312/245

(58) Field of Classification Search ..... 248/188.2, 248/188.4, 354.3, 188.3; 312/245
See application file for complete search history.

(56) References Cited

U.S. PATENT DOCUMENTS

| | | | | |
|---|---|---|---|---|
| 2,403,338 | A * | 7/1946 | Butler | 108/64 |
| 2,803,510 | A * | 8/1957 | Carbary | 312/351.13 |
| 2,975,546 | A * | 3/1961 | Beene, III | 248/188.3 |
| 4,221,363 | A | 9/1980 | Jasper | |
| 4,513,955 | A | 4/1985 | Daubon | |
| 4,789,121 | A | 12/1988 | Gidseg et al. | |
| 4,955,569 | A | 9/1990 | Hottmann | |
| 5,092,550 | A | 3/1992 | Bettini | |
| 5,169,219 | A * | 12/1992 | Obbink | 312/245 |
| 5,660,362 | A | 8/1997 | Selby et al. | |
| 5,732,913 | A * | 3/1998 | Shin | 248/188.2 |
| 6,062,791 | A | 5/2000 | Simon | |
| 6,607,341 | B1 * | 8/2003 | Wade | 414/10 |
| 6,863,253 | B2 | 3/2005 | Valentz et al. | |
| 6,910,665 | B2 | 6/2005 | Avendano et al. | |
| 6,910,666 | B2 | 6/2005 | Burr | |
| 2006/0102815 | A1 * | 5/2006 | Erdmann et al. | 248/188.2 |
| 2006/0124810 | A1 * | 6/2006 | Cotto | 248/188.4 |
| 2007/0277350 | A1 * | 12/2007 | Hines | 16/35 R |
| 2008/0116330 | A1 * | 5/2008 | Cotto | 248/188.4 |

OTHER PUBLICATIONS

Internet product sheet, "Part Details," Plastic Leveler 4.5"-6"—Cabinet Leveling Systems, www.cabinetparts.com, two pages (Nov. 2007).
Internet product sheet, "CAB-LOC Mobile Leveling System," www.benchdog.com, one page (2005).
Internet product sheets, "IEC levelers, swivel levelers, rigid levelers, hex levelers, legl leveler and screw leveler," International Equipment Components, www.levelingmounts.com, 15 pages (Nov. 2007).

* cited by examiner

*Primary Examiner*—J. Allen Shriver, II
*Assistant Examiner*—Bradley H Duckworth
(74) *Attorney, Agent, or Firm*—Lempia Braidwood LLC

(57) ABSTRACT

Disclosed herein is a system for leveling relative to a basis surface. The system includes an object having a first side confronting the basis surface and a second side opposite of the first side, a rod positioned to extend beyond the first side of the object to space the object from the basis surface and beyond a second side of the object to provide access to the rod, and first and second couplers to couple the rod and the object. Each of the first and second couplers includes a respective threaded hole threadably engaged with the rod to a position in which respective surfaces of the first and second couplers are in contact with, and rotationally stationary with respect to, the first and second sides of the object, respectively, such that rotation of the rod translates into translational displacement of the first and second couplers and the object.

14 Claims, 5 Drawing Sheets

LEVELING SYSTEM AND METHOD

BACKGROUND OF THE DISCLOSURE

1. Field of the Disclosure

The disclosure relates generally to leveling cabinets and other objects and, more particularly, to leveling systems and methods involving accessible leveling device assemblies.

2. Brief Description of Related Technology

Kitchen cabinetry sets typically include a number of units installed on the kitchen floor. Such floor-mounted cabinet units, or base cabinets, provide support for countertops, as well as inner storage space via shelves and drawers. Base cabinets are often installed around the perimeter, or walls, of a room, although some units are arranged to form a standalone island for the interior of a kitchen.

Installation of base cabinets usually requires leveling each unit to compensate for uneven or non-level flooring that would otherwise lead to non-level countertops and shelving. Cabinet installation consequently involves placing the cabinet in position on the floor for an initial assessment. Shims are then inserted at various locations between the unit and the flooring until the unit is satisfactorily level. In this way, shim-based leveling can be iterative or repetitious in nature, as each additional shim adjustment warrants another level assessment and possibly further shim adjustments.

Unfortunately, the location of a cabinet unit can render adjustments via leveling shims difficult. Gaining access to the rear of a cabinet unit to insert a shim may be impracticable, if not impossible, given the presence of other units or adjacent walls. For example, a cabinet unit to be installed in a corner often should be installed first to provide an opportunity for inserting shims without obstruction from adjacent units. Many kitchen cabinetry sets, however, include more than one corner unit, which can lead to complications arising from lack of accessibility to the rear of a unit.

Shim-based leveling can be problematic even when access is relatively unobstructed. Cabinet units are typically very heavy, and accordingly not easily lifted or moved, which may be necessary to insert a shim. Moreover, once the shim is inserted to an appropriate extent, only part of the shim is typically disposed under the cabinet unit. The excess portion of the shim must then be trimmed for aesthetic reasons, a step that risks accidental damage to the flooring and the cabinet unit.

SUMMARY OF THE DISCLOSURE

In accordance with one aspect of the disclosure, a system is useful for leveling relative to a basis surface. The system includes an object having a first side confronting the basis surface and a second side opposite of the first side, a rod positioned to extend beyond the first side of the object to space the object from the basis surface and beyond a second side of the object to provide access to the rod, and first and second couplers to couple the rod and the object. Each of the first and second couplers includes a respective threaded hole threadably engaged with the rod to a position in which respective surfaces of the first and second couplers are in contact with, and rotationally stationary with respect to, the first and second sides of the object, respectively, such that rotation of the rod translates into translational displacement of the first and second couplers and the object.

In some cases, the object has a hole between the first and second sides through which the rod extends. Alternatively or additionally, each of the first and second couplers includes a respective plate to engage a surface of the first or second sides of the object.

The system may further include a fixture disposed on the rod at a position beyond the second side of the object, where the fixture includes an interface to facilitate rotation of the rod. The fixture interface may include a nut-shaped exterior surface of the fixture.

In some cases, the system further includes a foot positioned as a barrier between the rod and the basis surface.

In accordance with another aspect of the disclosure, a method of leveling an object relative to a basis surface includes the steps of (i) positioning a threaded rod to extend beyond a first side of the object confronting the basis surface to space the object from the basis surface and beyond a second side of the object opposite the first side to provide access to the threaded rod on the second side of the object, (ii) coupling the threaded rod and the object with first and second threaded fittings threadably engaged with the threaded rod and positioned along the threaded rod such that respective surfaces of the first and second fittings are in contact with, and rotationally stationary with respect to, the first and second sides of the object, respectively, and (iii) imparting a rotational force to the threaded rod on the second side of the object to displace the first and second fittings and adjust a spacing between the object and the basis surface.

In some cases, the positioning step includes feeding the threaded rod through a hole passing through the object between the first and second sides. Alternatively or additionally, the imparting step may include engaging a fixture disposed on the threaded rod at a position beyond the second side of the object, where the fixture includes an interface to facilitate rotation of the threaded rod.

The method may also include the step of disposing a foot between the rod and the basis surface to act as a protective barrier during the imparting step.

In some cases, the adjusted spacing between the object and the basis surface may be secured. Thereafter, the threaded rod and the object may then be de-coupled by rotating the threaded rod counterclockwise until the threaded rod is no longer threadably engaged with the first threaded fitting.

In yet another aspect of the disclosure, a method is useful for leveling a cabinet unit relative to a floor surface. The method includes the step of installing a plurality of leveling device assemblies through a horizontal shelf of the cabinet unit spaced from the floor surface. Each leveling device assembly includes a threaded rod extending through a respective hole in the horizontal shelf to space the horizontal shelf from the floor and first and second coupler fittings threadably engaged with the threaded rod and positioned along the threaded rod such that respective surfaces of the first and second coupler fittings are in contact with, and rotationally stationary with respect to, first and second sides of the horizontal shelf, respectively, where the first side faces the floor and the second side is opposite the first side. The method also includes the steps of imparting a rotational force to the threaded rod of a selected leveling device assembly of the plurality of leveling device assemblies to displace the first and second coupler fittings of the selected leveling device assembly and adjust a spacing between the horizontal shelf and the floor, securing the adjusted spaced between the horizontal shelf and the floor, and removing the threaded rod of each leveling device assembly of the plurality of leveling device assemblies by rotating the threaded rod to an extent to disengage the first coupler fitting.

BRIEF DESCRIPTION OF THE DRAWING FIGURES

For a more complete understanding of the disclosure, reference should be made to the following detailed description and accompanying drawing figures, in which like reference numerals identify like elements in the figures, and in which.

Figure 1:
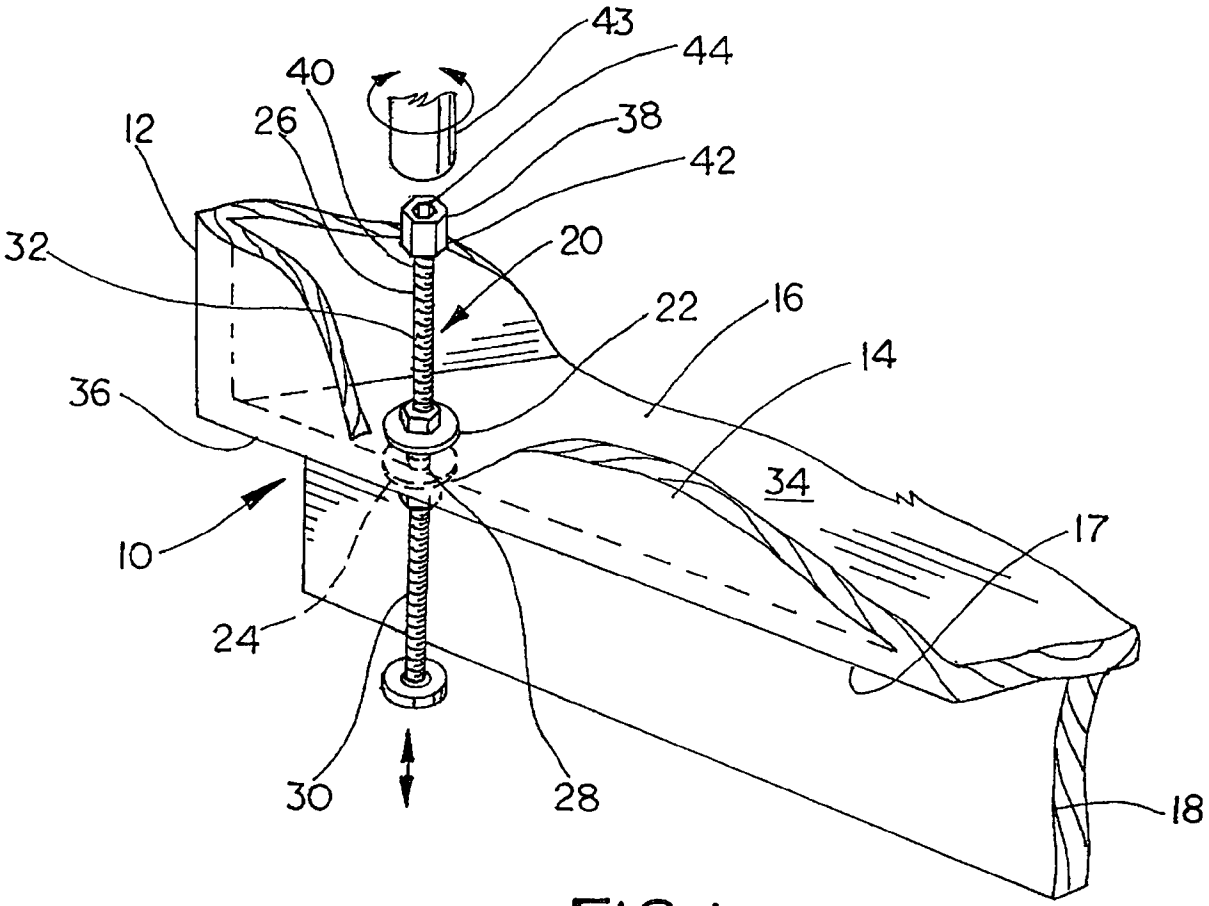
FIG. 1 is a perspective view of an exemplary cabinet leveling system configured in accordance with one aspect of the disclosure and assembled on a cabinet unit shown partially in cutaway.

While the disclosed systems, devices and methods are susceptible of embodiments in various forms, there are illustrated in the drawing (and will hereafter be described) specific embodiments of the invention, with the understanding that the disclosure is intended to be illustrative, and is not intended to limit the invention to the specific embodiments described and illustrated herein.

DETAILED DESCRIPTION OF PREFERRED EMBODIMENTS

The invention generally relates to leveling systems, devices and techniques directed to facilitating level adjustments of an object, such as a cabinet unit. The level adjustments are generally facilitated by the accessibility of the leveling devices or device components. Certain aspects of the disclosure facilitate level adjustments via maintaining accessibility throughout the procedure, even after the object to be leveled has been disposed in an installation position. For example, adjustments involve leveling devices that can be accessed above a bottom shelf of a cabinet unit. In this way, the leveling devices are accessible from within the cabinet, and adjustments near the rear of the cabinet unit are feasible.

Although the device assembly described below is associated with the leveling of base cabinetry, the disclosed systems, devices, and techniques are also well suited for leveling or supporting a variety of other objects and structures. Moreover, the object or structure need not be disposed on a floor or other horizontal surface. For example, the object may be leveled with respect to a vertical basis, such as a wall. Thus, the examples set forth herein should be broadly and generally understood to involve applying the disclosed systems, devices, and techniques to structures having an object with a surface to be leveled relative to a basis surface.

One aspect of the disclosed systems and techniques involves a rod extending to both sides of the object to be leveled. In some cases, the rod is fed through a hole in the object to be leveled. After locating the rod through the hole, a pair of leveling devices act as couplers, engaging the rod and the object to be leveled. For example, a pair of threaded couplers can be configured to provide surfaces that support or engage a cabinet shelf above flooring in contact with the rod. The axial length of the couplers also help to maintain the positioning of the rod relative to the cabinet shelf. As described below, rotation of the rod thereby causes the relative position of the threaded couplers to be adjusted, which in turn moves the cabinet floor relative to the flooring.

One aspect of the disclosed techniques involves the accessibility of the rod(s) used to level an object. Because an end of the rod is accessible above the object to be leveled, the object need not be tipped over or otherwise moved from its rest position during the leveling procedure. In this way, the disclosed techniques avoid having to make adjustments to feet or other adjusters located under the surface to be leveled. The disclosed techniques therefore differ from typical kitchen appliance support configurations, in which one must reach or otherwise access an adjustable foot located under the appliance.

The disclosed techniques also differ from conventional leveling procedures because the devices of the leveling assembly can generally be removed. For example, the object can be secured in place (or otherwise supported via, for instance, shims) to maintain the level established by the disclosed system, after which the rod(s), coupler(s), and other components can be removed. This is in contrast to the feet that bear the weight of the appliance in the example described above. In some cases, the only visible artifacts of the disclosed techniques are the holes formed in the object to be leveled. However, in the kitchen cabinet context, the holes may be located in positions within the cabinet interior not exposed during normal use, or can be filled or otherwise masked. One or more coupling devices can also remain below the cabinet flooring in certain situations after removal of the rod, but any such devices will be enclosed by the cabinet unit, as described below, and therefore not be visible after installation.

Turning now to the drawings, FIG. 1 depicts one example of a leveling system indicated generally at 10 and applied in a context to adjust a cabinet 12 near a front face 14 thereof. In this example, the cabinet 12 has a bottom shelf 16 with an overhang 17 that extends outward from a toe kick plate or cover 18. The leveling system 10 is positioned and installed through the overhang 17, such that, in this case, device components of the system 10 disposed beneath the bottom shelf 16 are retrievable. However, positioning the leveling system 10 to engage the overhang 17 is only one example and is shown here for convenience in illustration. While this location can provide benefits as described below, a number of aspects of the disclosed techniques address the challenges presented by other installation locations behind the toe kick plate 18.

The leveling system 10 includes a device assembly indicated generally at 20 that engages an object of the cabinet 12 to be leveled with respect to a basis surface, e.g., the underlying flooring. In this example, the object acted upon and engaged by the device assembly 20 is the bottom shelf 16 of the cabinet 12. More specifically, the device assembly 20 includes a pair of couplers 22, 24 and a threaded rod 26. Each coupler 22, 24 is a threaded fitting configured to threadably engage the rod 26 to fasten or couple the rod 26 and the bottom shelf 16. The rod 26 is positioned upright, or vertically, in a hole 28 formed in the bottom shelf 16 of the cabinet 12 such that a lower portion 30 of the rod 26 extends downward beneath the shelf 16 and an upper portion 32 extends upward above the shelf 16. The couplers 22, 24 are positioned along the rod 26 such that the couplers 22, 24 are in contact with respective sides of the shelf 16. More specifically, the coupler 22 is disposed on the upper portion 32 of the rod 26 to engage an upper surface 34 of the shelf 16, while the coupler 24 is disposed on the lower portion 30 of the rod 26 to engage a lower surface 36 of the shelf 16. In this way, the shelf 16 is pinched between the pair of couplers 22, 24, thereby securing the rod 26 in an upright, or vertical, position, and maintaining a fixed rotational position of the couplers 22, 24.

The couplers 22, 24 and the rod 26 may be made of a variety of materials. In one example, the couplers 22, 24 and the rod 26 are made of a metallic material (e.g., steel) or other materials of sufficient strength, such as hardened plastic materials. The couplers 22, 24 and the rod 26 may include more than one material or material layer, in which case certain materials or layers may be provided for different purposes. For example, the couplers 22, 24 may have a metal layer to bear the loads involved in the leveling operation and a rubber or other tacky material to grip the bottom shelf 16.

In this example, the device assembly 20 also includes a fixture 38 located at or near an end 40 of the rod 26 to provide a convenient receptacle or interface for a tool to drive the device assembly 20. The fixture 38 is located above the shelf 16 on the upper portion 32 of the rod 26 such that the fixture 38 and, more generally, the device assembly 20, can be conveniently accessed after the cabinet 12 has been set in place. In some cases, the fixture 38 may include a cap or head fixedly connected to the rod 26 at the end 40. More generally, the fixture 38 is configured to be engaged by one or more tools used to rotate the device assembly 20. In this example, the driver 38 has a hexagonal exterior surface 42 suitable for engagement by, for instance, a socket 43 of a wrench or a nut driver. The exemplary fixture 38 also has a cavity 44 configured to receive a different tool, such as a hex-key tool (e.g., an Allen wrench). The shape of the cavity 44 may vary considerably from the example shown, which is shaped to receive a hexagonal fitting like an Allen wrench. Alternatives may include one or more slots to receive a screwdriver (see, e.g., FIG. 2). It follows that a number of different tools may be used to drive the device assembly 20. In contrast to the example shown, some embodiments may present only a single receptacle or interface for a driver or tool. For instance, in one case, the fixture 38 includes a hand grip at or near the end 40 of the rod 26 to facilitate rotation by an operator. In each of the above-described examples, the fixture 38 ultimately provides an interface for an operator to engage and rotate the rod 26, with or without a manual or powered tool. Nonetheless, a power tool such as a portable drill equipped with a nut driver socket may be useful in making, for example, quick or coarse adjustments.

The fixture 38 may be secured to the rod 26 in any way, as desired. In this example, the fixture 38 can be secured to the rod 26 by welding, via the application of an adhesive, or other suitable fastening mechanisms or techniques. The fastening mechanism for the fixture 38 may vary considerably and be selected to suit type of fitting secured at or near the end 40 of the rod 26. Fittings can include locking nuts, end caps, wing nuts, and the like. Alternatively, the rod 26 and the fixture 38 are of unitary, or one-piece, construction as, for instance, a bolt with an integral bolt head or cap. For example, the rod 26 and the fixture 38 may be provided via a cap bolt, a flange bolt, a carriage bolt, and the like.

Figure 2:
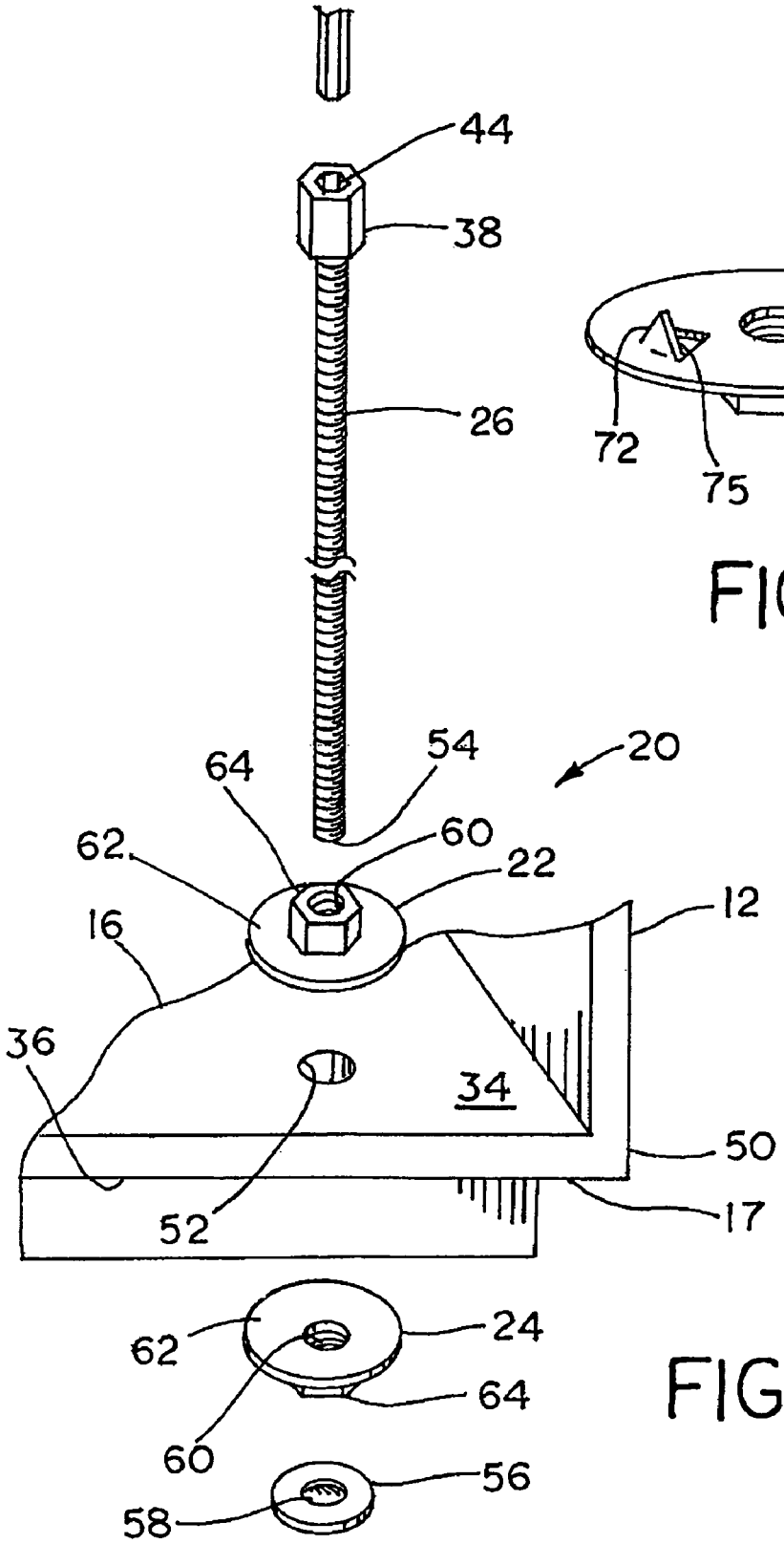
FIG. 2 is an exploded view of the exemplary cabinet leveling system of FIG. 1 to depict cabinet leveling device fittings in greater detail and in accordance with one embodiment.

With reference now to FIG. 2, the device assembly 20 is shown in an exploded view to depict the device components thereof in greater detail in connection with a front corner 50 of the cabinet unit 12. For convenience in illustration, the cabinet unit 12 is depicted without a front door or the front face 14 (FIG. 1). A hole 52 is formed in the shelf 16 of the cabinet 12 near the corner 50 and sized to receive the rod 26. The hole 52 may pass through the overhang 17, as described above in connection with FIG. 1. Before the rod 26 is fed through the hole 52, however, the coupler 22 is threaded onto the rod 26. In this way, the coupler 22 is positioned above the shelf 16 to engage the upper surface 34. After an end 54 of the rod 26 passes through the hole 52, the coupler 24 is threaded onto the rod 26 to engage the lower surface 36 of the shelf 16.

Eventually, the rod 26 is positioned within the hole 52 so that the end 54 of the rod 26 is disposed at a height appropriate for making level adjustments. In this case, the appropriate height corresponds with setting the length of the portion 30 of the rod 26 to approximate the space between the basis surface (e.g., floor) and the overhang 17. During the leveling adjustments to follow, the position of the rod 26 within the hole 52 is adjusted such that, at times, portions of the cabinet unit 12 will no longer rest on the floor, but rather be supported above the floor by the rod 26.

In this exemplary embodiment, a foot 56 is provided to engage the end 54 of the rod 26 and provide a base upon which the rod 26 can rest. The foot 56 can help prevent or avoid damage to the flooring that may result from the rod 26 impacting the flooring during the level adjustments. The foot 56 acts as a protective barrier for the flooring. The materials, construction, and configuration of the foot 56 may vary considerably. In this example, the foot 56 includes a circular base with a central depression 58 sized to receive the end 54 of the rod 26. The central depression 58 can help minimize lateral movement of the rod 26 while it is rotated. A variety of materials or material combinations may be useful to protect the flooring, as well as maintain the position of the foot 56 on the flooring. For instance, the foot 56 may include a steel disc and one or more rubber or rubber-like layers affixed thereto. More generally, the device assembly 20 need not include the foot 56. Accordingly, implementation of the disclosed techniques may involve optional or selective utilization of the foot 56, such as only when necessary to protect flooring that may be easily damaged or readily visible after installation.

Each coupler 22, 24 generally includes a threaded interior or other pass-through hole 60 to engage the rod 26. Each coupler 22, 24 also generally includes an external flange, plate or other laterally extending portion 62 to engage the shelf 16. In this example, the threaded interior 60 is provided by a nut 64, although a variety of other configurations are suitable. Generally speaking, the shape of the object in which the threaded interior 60 is formed may vary considerably. The object or, more generally, the coupler of which it is a part, has an axial length to support a sufficient number of threads for suitable engagement of the rod 26. The axial length may also be selected to provide sufficient rigidity to the device assembly 20 to minimize bowing or other lateral displacement of the rod 26. In this way, the couplers 22, 24 work together, combining to engage an axial length of the rod 26 to keep the rod 26 vertical, not letting the rod 26 tip or otherwise be laterally displaced from its vertical orientation. For example, each nut 64 may have an axial length of approximately 1.0-1.5 inches, for a combined 2-3 inches of rigidity.

In this exemplary case, the nut 64 serves an additional purpose, with the hexagonally arranged exterior surfaces providing a mechanism for rotating the coupler 22, 24 to position it along the rod 26 and to cinch or tighten the coupler 22, 24 in place against the surfaces of the shelf 16. Other configurations of the coupler 22, 24 may alternatively include a wing nut and other nut-based or nut-like options to facilitate rotation by hand or via a tool (e.g., a wrench). Still further alternatives to the nut 64 include non-nut objects configured for finger-tightening (e.g., one or more projections radially arranged and shaped to be engaged by a thumb and forefinger to facilitate twisting or turning about the axis formed by the rod 26).

The construction and configuration of the laterally extending portion or flange 62 of each coupler 22, 24 upon which the threaded interior 60 rests may also vary considerably. The flange 62 may be substantially flat, or plate-shaped, as shown in FIGS. 1 and 2. More generally, the flange 62 may have any thickness (i.e., axial length), and may be integrated with the threaded portion of the coupler 22, 24 to any desired extent. In this example, the flange 62 can be secured to the nut 64 in any desired manner, including, for instance, welding. Alternative configurations include one-piece or unitary constructions in which the threaded and flange portions of the couplers 22, 24 are combined.

The size of the flange 62 in the radial direction may be selected to ensure that the couplers 22, 24 sufficiently engage the surfaces 34, 36 of the shelf 16. In this example, the flange 62 is a ring-shaped plate having an outer diameter considerably greater than the diameter of the nut 64, and an inner diameter generally sized in accordance with the size of the nut 64 and the hole 52 to allow the rod 26 to pass through. More generally, the flange 62 is configured to support the nut 64 and distribute the load thereof, as in a washer, to the shelf 16 through substantial, flush contact with one of the surfaces 34, 36. In fact, the flange 62 need not be fixedly secured to the nut 64 or other threaded portion of the coupler 22, 24, in which case a washer can be used instead. However, a fixed connection between the flange 62 and the nut 64 may be useful, in some cases, to minimize the degree to which the couplers 22, 24 need to be tightened.

Figure 3:
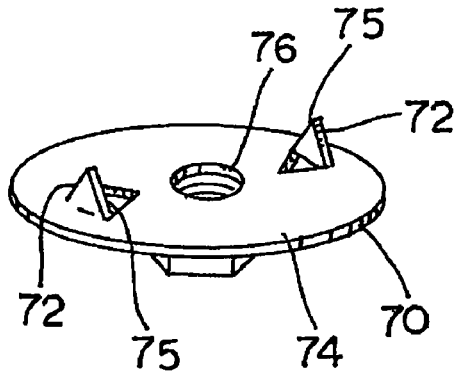
FIG. 3 is a perspective view of a cabinet leveling device fitting in accordance with another embodiment.

FIG. 3 depicts an alternative coupler 70 having barbs 72 protruding from a flange plate 74. Each barb 72 in this example is a triangular-shaped cutout 75 bent outward to extend generally perpendicularly from the plane of the plate 74. The barbs 72 are arranged along a diagonal in opposite directions from a center hole 76 in the plate 74. The barbs 72 serve to facilitate the engagement of the coupler 70 with the surface of the object to be coupled, such as the surfaces 34, 36 (FIGS. 1 and 2). The barbs 72 help to prevent the coupler from rotating with the rod 26 by securely seating a coupler on a surface or side of the object to be leveled.

The orientation and configuration of the barbs 72 may vary considerably. For example, the cutout 75 may be reoriented such that the plane of the cutout 75 is disposed in a radial or other direction from that shown. Other variations from the depicted barb 72 may involve a different arrangement of barbs 72 on the plate 74, including varying the positioning and number of barbs. Still other alternatives may include or involve the use of split locking washers, internal-external toothed locking washers, lock nuts, and the like.

Figure 4:
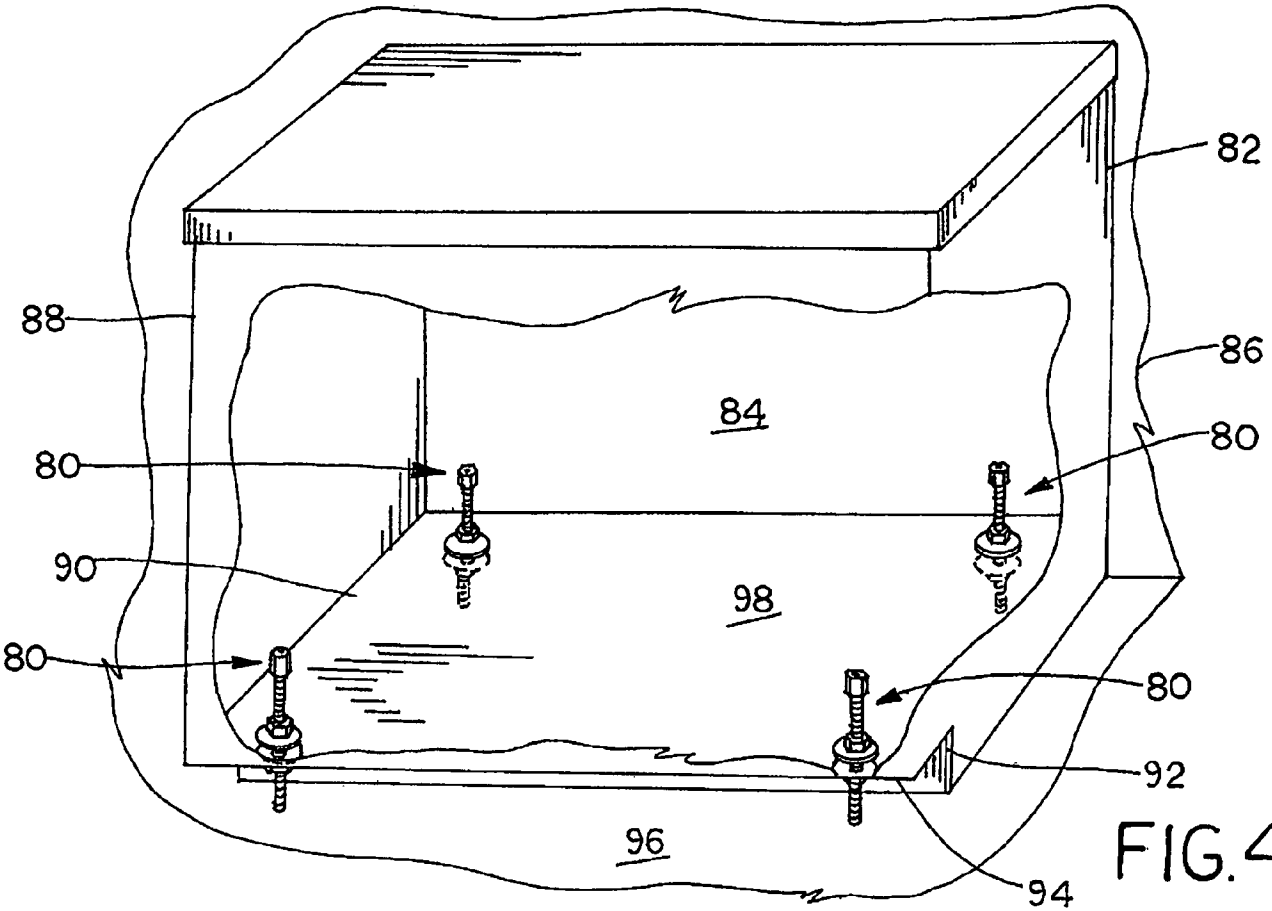
FIG. 4 depicts the cabinet leveling system of FIG. 1 installed in a cabinet unit using an exemplary technique in accordance with another aspect of the disclosure.

Turning to FIG. 4, the operation of four device assemblies 80 in accordance with one example of the disclosed leveling techniques is now described. The four device assemblies 80 may be configured in accordance with any one of the exemplary embodiments described above. The leveling technique described below is set forth with the understanding that it is exemplary in nature and that the positioning, arrangement, and number of device assemblies may vary as desired.

Each device assembly 80 is installed in or near a respective corner of a cabinet unit 82. Thus, two of the device assemblies 80 are located near a back wall 84 of the cabinet 82, which, in this case, is positioned against a room wall 86. The other two device assemblies 80 are located near a front face 88 of the cabinet 82. Each device assembly 80 engages a bottom shelf 90 of the cabinet unit 82 in the manner described above, with the two device assemblies 80 near the front face 88 positioned to engage an overhang 92 of the shelf 90. Engagement of the shelf 90 involves tightening the couplers of each device assembly 80 against respective sides or surfaces of the shelf 90. More specifically, each device assembly 80 has a coupler engaging a lower or inward side 94 of the shelf 90 confronting or facing a floor surface 96 upon which the cabinet unit 82 rests. Each device assembly 80 also has a coupler engaging an upper or outward side 98 of the shelf 90 opposite the confronting side 94. As the cabinet unit 82 rests on the floor 96, the confronting side 94 can be considered the obstructed or less accessible side, while the opposite side 98 can be considered the unobstructed or more accessible side. Access to the confronting side 94 is further restricted once the cabinet unit 82 is secured to the wall 86. In fact, in some cases, the lower couplers of the device assemblies 80 near the wall 86 may no longer be accessible at all, as described below.

Initial setup of the device assemblies 80 generally includes positioning the respective rod of each device assembly 80 in the corresponding hole in the shelf 90 and tightening the couplers until the respective surface is engaged. The rod of each device assembly 80 is positioned within the hole in the shelf 90 such that the lower end of the rod reaches or impacts the floor 96. At that point, the rod may or may not be bearing the load of the cabinet unit 82. Further details regarding the initial setup of each device assembly 80 is set forth below in connection with FIG. 5.

With each device assembly 80 in place, leveling of the cabinet unit 82 proceeds via the selective actuation of the device assemblies 80 to raise or lower the corresponding corner of the cabinet unit 82. Specifically, a rotational force applied to the rod of a selected device assembly 80 in the clockwise direction translates into an upward height adjustment at that location. Conversely, a rotational force in the counterclockwise direction translates into a downward height adjustment. These translations from rotation to translational movement are the result of the lack of rotation of the couplers of the device assembly 80. The couplers travel upward and downward along the rod as a result of the rotation of the rod, which in turn adjusts the height of the shelf 90 relative to the floor 96. The couplers cannot rotate with the rod in either direction because of the friction securing the couplers to the cabinet surfaces 94, 98. Moreover, because the device assemblies 80 may bear the load of the cabinet unit 82, the friction securing the couplers in place may be enhanced by the weight of the cabinet unit 82. It should be noted that the size of the rod 26 (and, thus, other device components) may vary and be selected in view of the weight or size of the cabinet unit 82 and other factors, such as the arrangement and number of device assemblies 80.

Figure 5:
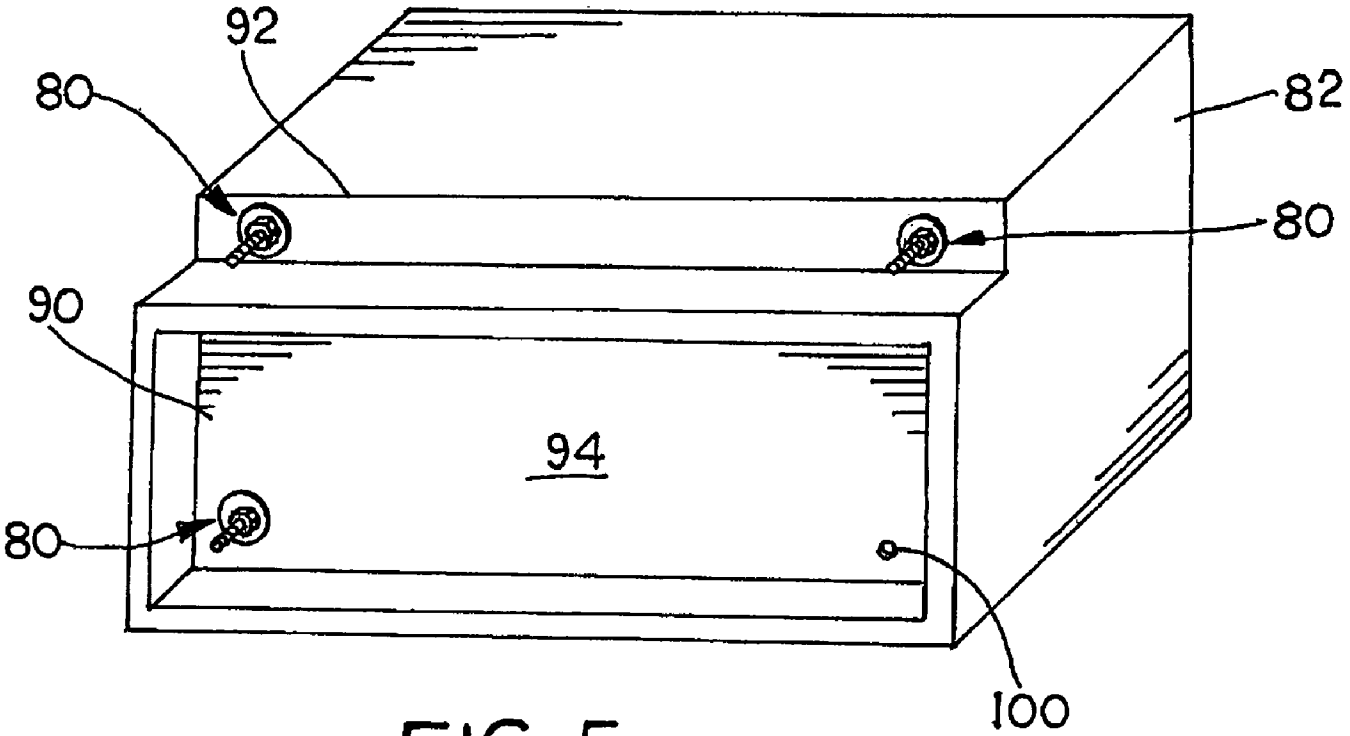
FIG. 5 depicts an initial installation step of the exemplary technique of FIG. 4 in which the cabinet leveling system is positioned in corners of a cabinet unit to be leveled.

An exemplary initial setup for the leveling of the cabinet unit 82 is depicted in FIG. 5. The cabinet unit 82 is positioned on a side, such as the back wall 84 (FIG. 4) to expose the surface 94 that would normally confront or face the floor. Other techniques may expose the surface 94 merely by tilting or elevating the cabinet unit 82. By exposing the surface 94 of the cabinet unit 82, the positioning of the rods of the device assemblies 80 can be more conveniently set appropriately given the distance of the surface 94 from the floor. It may also help in the drilling of holes 100 in appropriate locations in the shelf 90 and the overhang 92 thereof.

The positioning of each device assembly 80 may be adjusted before the cabinet unit 82 is set upright. For example, with the coupler 24 (FIGS. 1 and 2) removed from the rod, the rod can be fed through the hole 100 until the coupler 22 (FIGS. 1 and 2) rests on the shelf 90. To this end, the interior of the cabinet unit 82 can be accessed through the front of the cabinet if the doors have yet to be installed. Alternatively or additionally, the interior of the cabinet unit 82 can be accessed through the top of the cabinet 82. Once the rods are pushed through the holes 100, the coupler 24 can then be threaded onto the rod until it reaches the surface 94 of the shelf 90. At this point, rotation of the rod will translate into translational movement of the rod within the hole 100. The position of the coupler 80 can thus be adjusted to a desired initial position.

Notwithstanding the foregoing, it should be noted that some of the initial or preliminary adjustments may also be made after the cabinet unit 82 is set upright. For example, the positioning of the rod within the hole 100 need not be exactly at the height at which the weight of the cabinet transfers to the rod. In some cases, it may be useful to initially set the rod in a position in which the weight would remain off the rod until further downward adjustment during the leveling steps.

Figure 7:
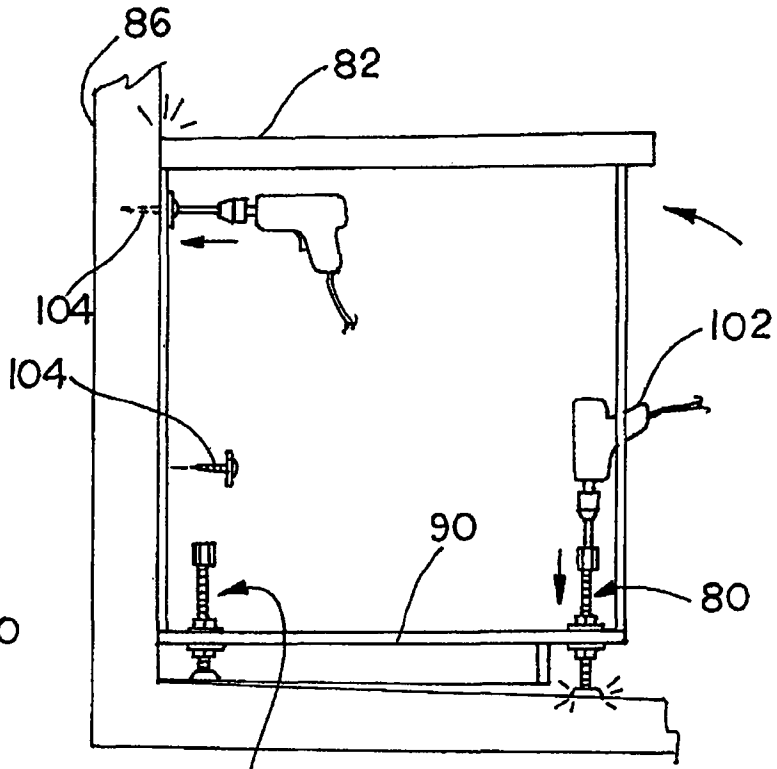
Figure 6:
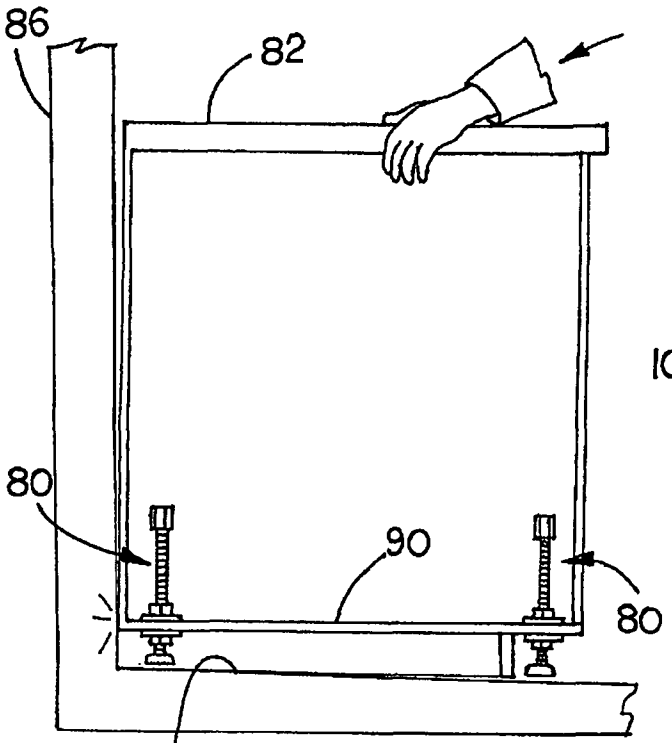
FIG. 6 is a side view of a cabinet unit during a preliminary step of an exemplary cabinet leveling technique that may follow the initial installation step depicted in FIG. 4; and, FIG. 7 is another side view of a cabinet unit during level adjustment and attachment steps of an exemplary cabinet leveling technique that may follow the initial and preliminary steps of FIGS. 5 and 6.

FIGS. 6 and 7 depict the cabinet unit 82 with a side panel or wall removed to illustrate subsequent stages of the cabinet leveling procedure in accordance with an exemplary embodiment. In FIG. 6, a user is shown positioning the cabinet unit 82 adjacent the wall 86 after each device assembly 80 has been disposed in its respective initial position. FIG. 7 depicts the actuation of one of the device assemblies 80 with a nut driver 102. In this example, the nut driver 102 is rotating a selected device assembly 80 clockwise to raise that portion of the shelf 90 as shown. Once each device assembly 80 is adjusted to level the cabinet unit 82, the cabinet unit 82 may be secured to the adjacent wall 86 via screws 104 or other fasteners. The cabinet unit 82 may also or alternatively be secured in its leveled state to an adjacent cabinet unit (not shown).

A variety of other techniques to secure the position of the cabinet unit 82 may be alternatively or additionally utilized, including the insertion of shims (not shown) between the cabinet unit 82 and the floor 96. The insertion of shims will be less iterative and more directed or targeted as a result of the leveling already provided by the disclosed techniques. For example, measurements may be made to fabricate appropriate shims of a certain size. Moreover, once the shims are selected to support the desired height (i.e., level) adjustment, the shims can be inserted temporarily, marked to indicate a cut line, and then removed for cutting. In this way, the shims are sized so as to not stick out from the cabinet unit, and without risk of inadvertently cutting the floor or the cabinet unit 82 in the process. The shims can eventually be re-inserted to support the cabinet unit 82 in an unobtrusive manner.

Once the cabinet unit 82 is secured in a permanent, level position, the device assemblies 80 are removed. To that end, the nut driver 102 can be used to rotate each device assembly 80 counter-clockwise until the rod 26 is pulled out of the coupler 24. The rod 26 can then be withdrawn from the opening in the shelf 90. Other device components can then also be retrieved, including the coupler 24 when access is available. Re-use of the device components is then an option.

In some cases, it may be desirable to position the openings or holes for the device assemblies in locations within the cabinet unit that are not readily visible after installation. For example, the back or rear corners of the cabinet unit shelf may not be visible during use because of items placed on the shelf. With regard to the front locations, holes can be drilled off to the side of the door openings such that the remaining holes would not be visible from outside of the cabinet unit. Alternatively or additionally, the holes may be plugged, covered or disguised to remove any artifacts of the leveling procedure.

In cases involving a shelf overhang, the washer-like couplers described above may be replaced by an adjustable bracket or clamp-based coupler where the threaded holes or pass-throughs are formed in the plates of the bracket or clamp. Essentially the bracket or clamp plates can be considered extensions of the circular plate of the washer-like couplers described above. The part of the plates with the threaded hole would be spaced from the overhang in front of the cabinet unit, while the remainder of the plates would engage the cabinet shelf.

While the examples set forth above involve the leveling of a generally horizontal object above a floor, the disclosed systems, devices and methods are not limited to leveling above a horizontal floor. The device assemblies described herein are equally well suited for deployment with respect to other basis surfaces, such as downward from a higher horizontal surface (e.g., a ceiling) or laterally from a non-horizontal surface (e.g., a wall).

While the present invention has been described with reference to specific examples, which are intended to be illustrative only and not to be limiting of the invention, it will be apparent to those of ordinary skill in the art that changes, additions and/or deletions may be made to the disclosed embodiments without departing from the spirit and scope of the invention.

The foregoing description is given for clearness of understanding only, and no unnecessary limitations should be understood therefrom, as modifications within the scope of the invention may be apparent to those having ordinary skill in the art.

What is claimed is:

1. A system for leveling relative to a basis surface, the system comprising:

an object having a first side confronting the basis surface, a second side opposite the first side, and an unthreaded hole between the first and second sides;

a rod positioned in the unthreaded hole to extend beyond the first side of the object to space the object from the basis surface and beyond the second side of the object to provide access to the rod; and, first and second couplers to couple the rod and the object, the first and second couplers each comprising a respective threaded hole threadably engaged with the rod to a position in which respective surfaces of the first and second couplers are in contact with, and rotationally stationary with respect to, the first and second sides of the object, respectively, to pinch the object between the first and second couplers such that rotation of the rod translates into translational displacement of the first and second couplers and the object.

2. The system of claim 1, wherein each of the first and second couplers comprises a respective plate to engage a surface of the first or second sides of the object.

3. The system of claim 1, further comprising a fixture disposed on the rod at a position beyond the second side of the object, wherein the fixture comprises an interface to facilitate rotation of the rod.

4. The system of claim 3, wherein the fixture interface comprises a nut-shaped exterior surface of the fixture.

5. The system of claim 1, further comprising a foot positioned as a barrier between the rod and the basis surface.

6. A method of leveling an object relative to a basis surface, the method comprising the steps of:

feeding a threaded rod through an unthreaded hole in the object;

positioning the threaded rod in the unthreaded hole to extend beyond a first side of the object confronting the basis surface to space the object from the basis surface and beyond a second side of the object opposite the first side to provide access to the threaded rod on the second side of the object;

coupling the threaded rod and the object with first and second threaded fittings threadably engaged with the threaded rod and positioned along the threaded rod such that respective surfaces of the first and second fittings are in contact with, and rotationally stationary with respect to, the first and second sides of the object, respectively, to pinch the object between the first and second threaded fittings; and, imparting a rotational force to the threaded rod on the second side of the object to displace the first and second fittings and adjust a spacing between the object and the basis surface.

7. The method of claim 6, wherein the imparting step comprises engaging a fixture disposed on the threaded rod at a position beyond the second side of the object, and wherein the fixture comprises an interface to facilitate rotation of the threaded rod.

8. The method of claim 7, wherein the fixture interface comprises a nut-shaped exterior surface of the fixture.

9. The method of claim 6, further comprising the step of disposing a foot between the rod and the basis surface to act as a protective barrier during the imparting step.

10. The method of claim 6, further comprising the steps of securing the adjusted spacing between the object and the basis surface and, after the securing step, de-coupling the threaded rod and the object by rotating the threaded rod counterclockwise until the threaded rod is no longer threadably engaged with the first threaded fitting.

11. A method of leveling a cabinet unit relative to a floor surface, the method comprising the steps of:

installing a plurality of leveling device assemblies through a horizontal shelf of the cabinet unit spaced from the floor surface, each leveling device assembly comprising a threaded rod extending through a respective unthreaded hole in the horizontal shelf to space the horizontal shelf from the floor and first and second coupler fittings threadably engaged with the threaded rod and positioned along the threaded rod such that respective surfaces of the first and second coupler fittings are in contact with, and rotationally stationary with respect to, first and second sides of the horizontal shelf, respectively, to pinch the horizontal shelf between the first and second coupler fittings, wherein the first side faces the floor and the second side is opposite the first side;

imparting a rotational force to the threaded rod of a selected leveling device assembly of the plurality of leveling device assemblies to displace the first and second coupler fittings of the selected leveling device assembly and adjust a spacing between the horizontal shelf and the floor;

securing the adjusted spacing between the horizontal shelf and the floor; and removing the threaded rod of each leveling device assembly of the plurality of leveling device assemblies from the respective unthreaded hole by rotating the threaded rod to an extent to disengage the first coupler fitting.

12. The method of claim 11, wherein each leveling device assembly of the plurality of leveling device assemblies further comprises a fixture disposed on the threaded rod at a position above the horizontal shelf and comprising an interface to facilitate rotation of the threaded rod, and wherein the imparting step comprises engaging the fixture disposed on the threaded rod.

13. The method of claim 12, wherein the fixture interface of each leveling device assembly comprises a nut-shaped exterior surface of the fixture.

14. The method of claim 11, further comprising the step of disposing a foot between the threaded rod of at least one of the leveling device assemblies and the floor to act as a protective barrier during the imparting step.

* * * * *